US009199704B2

(12) United States Patent
Thom et al.

(10) Patent No.: US 9,199,704 B2
(45) Date of Patent: Dec. 1, 2015

(54) FLOATABLE DRY DOCKS

(75) Inventors: Donald Scot Thom, Cowes (GB); Richard Peter Bayley, Maidenhead (GB)

(73) Assignee: WELCOME INN INVESTMENTS NV, Curaco (AN)

( * ) Notice: Subject to any disclaimer, the term of this patent is extended or adjusted under 35 U.S.C. 154(b) by 40 days.

(21) Appl. No.: 13/129,716

(22) PCT Filed: Nov. 17, 2009

(86) PCT No.: PCT/GB2009/002681

§ 371 (c)(1),
(2), (4) Date: Jul. 27, 2011

(87) PCT Pub. No.: WO2010/058156

PCT Pub. Date: May 27, 2010

(65) Prior Publication Data

US 2011/0277675 A1 Nov. 17, 2011

(30) Foreign Application Priority Data

Nov. 18, 2008 (GB) ..... 0821086.6

(51) Int. Cl.
*B63C 1/06* (2006.01)
*B63C 1/02* (2006.01)

(52) U.S. Cl.
CPC .... *B63C 1/06* (2013.01); *B63C 1/02* (2013.01)

(58) Field of Classification Search
CPC ..... B63C 1/06; B63C 1/02; B63C 7/12; B63C 7/10
USPC ..... 114/44, 45, 50, 52, 125
See application file for complete search history.

(56) References Cited

U.S. PATENT DOCUMENTS 3,344,764 A 10/1967 Ziermann
3,685,533 A * 8/1972 Krechel ..... 137/115.05

(Continued)

FOREIGN PATENT DOCUMENTS

GB 2 009 055 A 6/1979
GB 2 144 375 A 3/1985
GB 2 442 216 A 4/2008
WO WO 2008/038009 A1 4/2008

OTHER PUBLICATIONS

Gast, Vacuum and Pressure Suystems Handbook, revised Electronic edition, retrieved Jul. 3, 2014 from http://www.gastmfg.com/vphb/vphb_s3.pdf, p. 55.*

(Continued)

*Primary Examiner* — S. Joseph Morano
*Assistant Examiner* — Andrew Polay
(74) *Attorney, Agent, or Firm* — Oliff PLC

(57) ABSTRACT

A floating dock including a submersible platform including at least one buoyancy tank wherein the buoyancy tank has a plurality of compartments each of which has a permanently open vent through which water is freely flowable into and out of the compartment and an inlet which enables air to be expelled from the compartment into the atmosphere or enables compressed air to be supplied to the compartment via a non return valve which causes water within the tank to be forced out via the vent, thereby increasing the buoyancy of the tank. The vent does not have any valves associated with it and is permanently open to the sea. As a result the floating dry dock of the present invention may be lowered and raised faster than conventional dry docks which rely on valved vents to control entry and exit of water into and out of their buoyancy tanks.

18 Claims, 3 Drawing Sheets

(56) References Cited

U.S. PATENT DOCUMENTS

| | | | | | |
|---|---|---|---|---|---|
| 3,688,719 | A | * | 9/1972 | Amirikian | 114/267 |
| 3,727,415 | A | * | 4/1973 | Williams | 405/3 |
| 3,976,022 | A | * | 8/1976 | Lapeyre | 114/45 |
| 4,018,179 | A | * | 4/1977 | Rutter | 114/45 |
| 4,510,877 | A | * | 4/1985 | Bloxham | B63C 1/06 114/45 |
| 4,615,289 | A | * | 10/1986 | Bloxham | 114/45 |
| 5,456,201 | A | * | 10/1995 | Bobst | 114/289 |
| 5,860,379 | A | | 1/1999 | Moody | |

OTHER PUBLICATIONS

Gast, Vacuum and Pressure Systems Handbook, Gast Manf, 1986.*

International Search Report for International Patent Application No. PCT/GB2009/002681, mailed on May 25, 2010.

Written Opinion for International Patent Application No. PCT/GB2009/002681, mailed on May 25, 2010.

* cited by examiner

FLOATABLE DRY DOCKS

TECHNICAL FIELD

This invention relates to dry dock systems for use in lifting vessels out of the water for maintenance or repair purposes. Typically these types of docks can lift anything from one to several hundred tonnes.

There are basically two types of dry dock. There are those comprising a lock that has at least one closable door into which the vessel is floated, and the water is drained from the lock to leave the vessel high and dry.

A second type of dry dock system comprises a floating dock that consists of a platform that is floated to a region ahead or astern of the vessel and submerged so as to be positioned beneath the vessel. The platform has sealed floatation tanks with fixed buoyancy and the platform is submerged or raised/floated by adding or removing weight to the platform in the form of water/ballast which is either flooded into or pumped out of the sealed floatation tanks. Conventional pumps can be used or compressed air can be used to displace the water from the flotation tanks, which reduces the weight of the platform with the result that the platform rises/floats due to the fixed buoyancy provided by the flotation tanks.

Such systems generally use compressed air to pump water out of the buoyancy tank which is under the control of various valves which seal or open the inlet and outlet of each sealed tank to control the amount of water and compressed air present inside it. However, such systems are limited in the number of inlets and outlets in each buoyancy tank as each inlet and outlet requires a valve which can be controlled remotely and these valves increase the cost and complexity of operation. This also causes drawbacks with respect to the time it takes for conventional floatable dry docks to be lowered into and raised out of the water due to the time it takes to operate the valves and the limitation in the volume of air and water that can be fed through the limited number of inlets and outlets. Thus, there is a need to provide dry dock facilities for boats at local harbours, moorings, club harbours or lagoons and the like which can be used to lift vessels out of the water rapidly thus saving valuable time and cost.

An aim of the present invention is to overcome the problems associated with prior art floatable dry docks. Specifically, an object of the present invention is to provide a floatable dry dock which is capable of being raised and lowered faster than conventional floatable dry docks. A further object of the invention is to provide a floatable dry dock that can be moved to the vessel to be lifted, as required.

BACKGROUND ART

U.S. Pat. No. 3,976,022 discloses a vessel lift having support legs anchored to the seabed, and open bottomed compartments which may be flooded or purged by means of remotely actuated valves. The compartments are disposed along the length of the vessel to be lifted, such that the trim of the vessel may be controlled during lifting.

GB2009055 discloses a vessel lift having tanks which may be flooded or purged through a valve to alter the buoyancy of a vessel-supporting platform.

U.S. Pat. No. 4,510,877 discloses a vessel lift having a floodable buoyancy device with several compartments, all served by a manifold providing compressed air to alter the buoyancy as required. Water is exhausted from the compartments by means of check valves.

SUMMARY OF THE INVENTION

In one aspect, the present invention provides a floating dock comprising a submersible platform comprising at least one buoyancy tank having a plurality of compartments each compartment having a permanently open vent through which water is freely flowable into and out of the compartment and an inlet wherein the inlets of each compartment are connected to one another and to a compressed air supply by a conduit having a first isolation valve provided between the inlet and the atmosphere, a second isolation valve provided between the inlet and the compressed air supply and a non-return valve between the second isolation valve and the compressed air supply wherein, in use, air is expelled from the compartment into the atmosphere to cause the dock to sink or compressed air is supplied to the plurality of compartments which increases the buoyancy of the tank.

DETAILED DESCRIPTION OF THE INVENTION

The use of permanently open and multiple vents significantly increases the speed of operation when compared to forcing water out of a single vent or outlet valve. The inlet is used to pump compressed air into the compartment, and it is also used to enable the compressed air to escape, which in turn enables water to flood into the compartment via the multiple vents, thereby submerging the compartment and the dock. There is a non return valve installed between each inlet connection and the compressed air supply to prevent commonality of the multiple compartments when they are all connected to a single compressed air source.

The buoyancy tank is a hollow structure the shape of which is determined by the shape of the submersible platform to which is it attached. Preferably, a buoyancy tank is provided along each edge and at the underside of the submersible platform. In one embodiment the tank is cylindrical in shape. The number of buoyancy tanks required will depend on the shape and size of the submersible platform and the weight of vessels that need to be lifted. In one embodiment the buoyancy tank may be provided as a single unit. In other embodiments, the platform itself is formed by a series of buoyancy tanks.

There is an inherent problem called the "free water effect" which is associated with buoyancy tanks that are partially filled with water. When a tank is part filled with water and is rotated slightly off horizontal the effect is that the water will shift to one side to maintain a level water surface which results in the centre of gravity of the combined structure moving significantly, and causes the tank to become unstable. With conventional floatable dry docks, a typical solution to this problem is to divide the buoyancy tank into multiple smaller sealed tanks such that the effect on the centre of gravity of the combined structure when rotating the buoyancy tank slightly off horizontal is significantly reduced. However, with conventional dry docks when dividing the buoyancy tank into multiple smaller tanks an additional inlet valve and at least one outlet valve must be added for each of the multiple smaller tanks. This increases cost and the complexity of operation and the speed with which the dock can be raised and submerged is extended due to the limited number of outlet valves for each of the multiple tanks through which the water ballast can flow.

Therefore, the buoyancy tank of the present invention is provided as a series of smaller tanks linked together or a single buoyancy tank having a series of partitions to form a series of buoyancy compartments.

The buoyancy tank comprises a vent through which water is freely flowable into the tank and through which the water may be forced out by introducing compressed air into the tank via the inlet valve. The vent may be located at an area of the buoyancy tank wall which is in contact with the sea which will enable water to freely flow in to the tank. Preferably the vent is located in the side of buoyancy tank closest to the bottom of the sea and runs along the entire length of the buoyancy tank. The vent may be a slat cut out of the wall of the buoyancy tank. Alternatively the vent may comprise a series of holes or a lattice along the length of wall of the buoyancy tank. Preferably each compartment comprises a plurality of vents. In one embodiment each tank has 30 holes of 100 mm diameter. The holes need not be limited to a circular shape. Any shape vent may be used as long as it enables free access of water in to and out of the tank without the use of valves at the vent. The vents are permanently opened to the water and do not require valves to open and close them. This significantly reduces the cost and complexity of operation, and enables many more vents to be used for each compartment which significantly increases the speed with which the dock can be raised/floated and submerged.

When the buoyancy tank is placed on the sea a single air inlet/exhaust valve on each compartment is opened, water will flow into the hollow body of the tank via the vents causing it to sink which in turn will cause the submersible platform to be lowered in to the sea. The inlet is provided in the wall of each of the compartments of the buoyancy tank through which compressed air may be forced in to the buoyancy tank via a pipe connected to an external compressed air supply. The inlet may be located at any point within the wall of the compartment. Preferably the inlet is located at the top of the compartment opposite the vents such that when air is supplied in to the tank at the top the water is pushed out through the vents in an even manner.

The inlet may be connected to a T piece or splitter via a flexible hose. One end of the T piece or splitter is connected to an external air compressor via a non return valve and the other end vents to the atmosphere.

The floating dry dock may include further buoyancy tanks which are closed (that is, they do not flood or purge to alter their buoyancy). These may be provided to assist in lifting vessels from the water, and to maintain the overall stability of the structure in the event of rough water conditions.

In a preferred embodiment, the closed buoyancy tanks are provided at the periphery of the floating dry dock. More preferably, the closed buoyancy tanks are pivotally attached to the floating dry dock.

FIGURES

A floating dry dock, which embodies the present invention, will now be described, by way of example only, with reference to the accompanying drawings in which.

Figure 1:
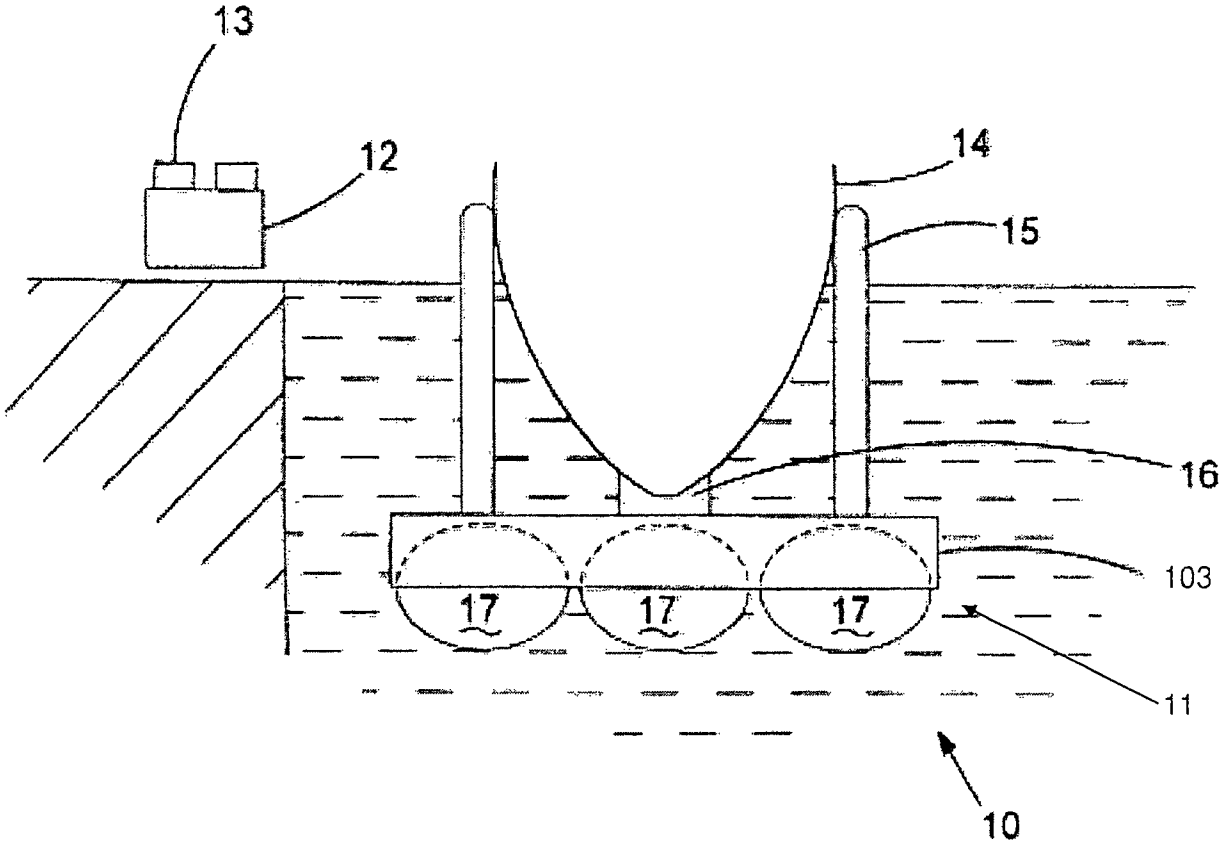
FIG. 1 is a cross section of a dry dock according to one aspect of the present invention with the submersible platform in its fully lowered position.

Referring to FIG. 1, there is shown a dry dock 10 comprising a floatable platform 11. The platform 11 is in the form of an elongate trimaran made of lightweight marine alloy or steel. The platform 11 could be a mono-hull, twin-hull or a cylindrical float or other floatable structure.

Mounted on the base 12 are the engines and, propulsion equipment (not shown), and all the controls and services 13 for piloting the base 12 to a location adjacent a vessel 14 to be lifted. The services 13 include pumps for flooding and emptying buoyancy tanks and other services.

In order to stabilise the vessel 14 during lifting or lowering, the floatable platform 11 is provided with supports 15 that are initially spaced apart and secured to the platform 11 at a width slightly wider than the width of the vessel 14. The supports 15 can be of a height that enables them to project out of the water (as shown on the left hand side of FIG. 1) so that the pilot can steer the vessel 14 into position between the supports. The supports 15 are positioned at equal distance from a plane of symmetry of the platform 11 so that the vessel 14 is located above the centre of gravity of the platform 11 to avoid tilting of the platform 11 during lifting or lowering. Along the centre of the platform 11 is provided a further support member 16 which runs along the centre line of the platform 11 which provides further support to the vessel 14 when mounted on the dock.

In this particular embodiment platform 11 may be considered as three buoyancy tanks 17 secured to the underside of a flat plate or a series of cross members 103. In other aspects the platform 11 may be provided as a table with a buoyancy tank 17 located along each length of the underside edge of the platform 11 or around the underside perimeter of the platform 11.

Figure 2:
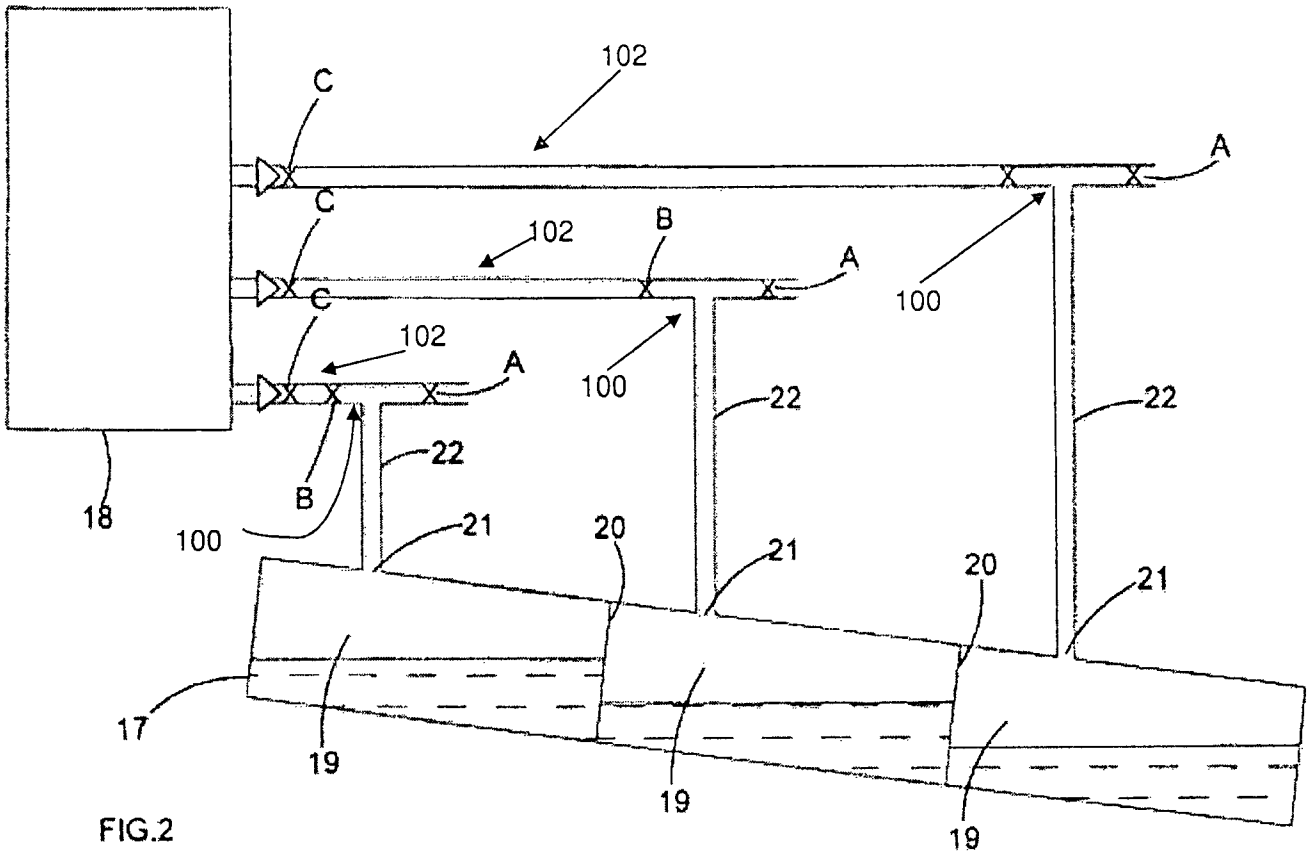
FIG. 2 is a schematic cross sectional view showing the positioning of isolating and non-return valves with respect to the inlets of the compartments of a buoyancy chamber according to one aspect of the present invention.

A buoyancy tank 17 according to one embodiment connected to an external compressed air supply 18 is shown in FIG. 2. The buoyancy tank 17 is generally a hollow cylinder with walls made from a light weight marine alloy or steel. The hollow interior of the buoyancy tank 17 is divided in to three chambers 19 by two partition walls 20 which are made from a light weight marine alloy or steel.

At the top of each chamber 19 is located an inlet 21 to which is connected a flexible hose 22 which in turn is connected to a splitter or T section 100 which splits the hose into two separate hoses. One of these is connected to an isolating valve A which when opened allows the air to escape from chamber 19 to the atmosphere and the other 102 is connected to an air compressor 18 located at a distance from the dry dock 10. A non-return valve B is installed between the air compressor and the splitter or T section 100 which allows compressed air to enter the chamber 19 via the inlet 21 but does not allow air to reflux from the chamber 19 to the common compressed air supply 18.

Figure 3:
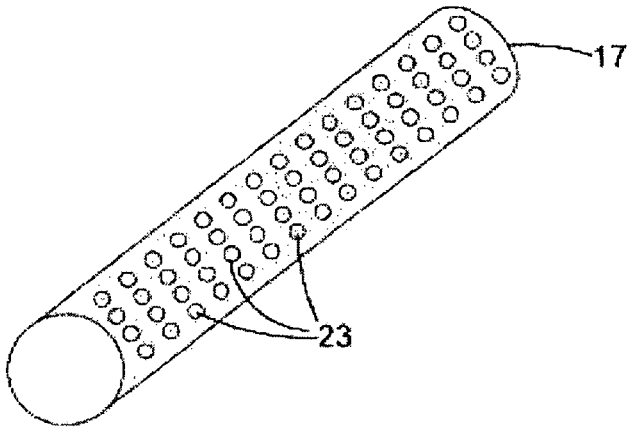
FIG. 3 is a schematic perspective view of the underside of a buoyancy chamber according to one aspect of the present invention.

As shown in FIG. 3, at the bottom of each chamber 19 is located a vent formed by holes 23 which are cut into the wall of the buoyancy tank 17. The holes 23 allow sea water in which the dry dock is submerged to be freely accessible to the interior of each chamber 19.

In operation, the dry dock 10 is floated out to where the vessel 14 to be lifted is located, or the vessel is floated to the vicinity of the dry dock 10. The dry dock 10 is positioned either astern or ahead of vessel 14. The air is allowed to escape from the buoyancy tank 17 by opening isolating valve A such that buoyancy tank 17 is flooded with water to submerge the platform 11 to a position where the vessel 14 can be floated into position between the supports 15. This position is shown in FIG. 1.

With the vessel 14 in place above the platform 11, the tanks 17 are purged of water by pumping in compressed air in to the chamber 19 via inlet 21 to increase the buoyancy of the tank 17 in a controlled manner. This causes platform 11 to rise. When raising the dock 10 isolating valves A will be closed and the operator will open isolating valves B to let air in from the compressor. Whilst valves B are open the non-return valves C prevent the air from leaving one tank 17 and entering another tank 17 via the air compressor 18. When the dock 10 is raised the isolation valves B are closed and the compressor 18 is turned off, the platform 11 is stable and air cannot enter or escape from the buoyancy tanks.

Figure 4:
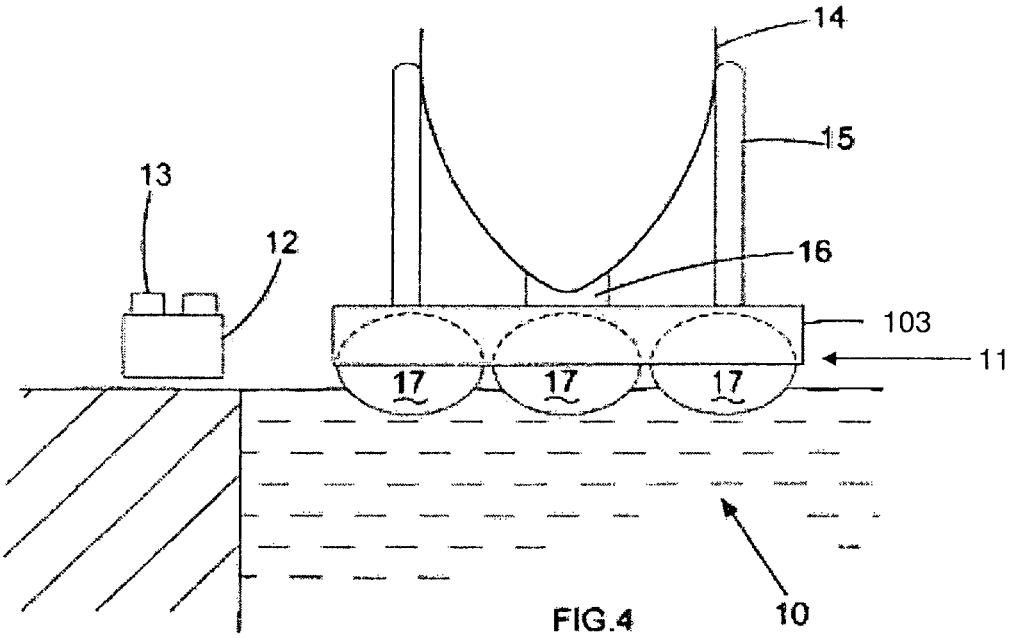
FIG. 4 is a cross section of a dry dock according to one aspect of the present invention with the submersible platform in the fully raised position.

Continued purging of water allows the vessel 14 to be lifted clear of the water surface as shown in FIG. 4. The free water effect within the tank 17 is minimised by the compressed air being unable to escape from one tank 17 back through the inlet 21 and into a different tank 17 via the common compressed air supply 18 by the presence of the non-return valve C. As a result the stability of the platform 11 during lowering and lifting is maintained.

In order to lower the vessel 14 after repair and maintenance from the position shown in FIG. 4 to the position shown in FIG. 1, the above procedure is reversed. That is to say, the air supply is switched off and the isolating valves A are opened such that the air in tank 17 escapes to the atmosphere enabling water to enter and flood tank 17 via the vents 23 causing it to sink.

The tank 17 of the present invention is not limited by the number of valves which are present to control the entry and exit of water due to the vent arrangement. In one embodiment an 18 m buoyancy tank 17 is divided into three separate compartments with each compartment having ten vents 23 which are holes of 100 mm diameter at the bottom. None of these vents require valves as they are permanently open to the sea. A similar dimensioned conventional floating dry dock may typically have one 100 mm diameter outlet which is opened and closed via a valve for each of the three compartments. As a result the speed at which the platform of the present invention is able to be raised and lowered is 10 times faster than the conventional dry dock alternative as it has 10 times more vents through which water can be removed from the buoyancy tanks. It is impractical for a conventional dry dock with sealed buoyancy tanks to be configured with the same number of outlets as the present invention as it would require thirty 100 mm diameter valves which would be expensive and very impractical to operate.

The invention claimed is:

1. A floating dock comprising:

a submersible platform comprising at least one buoyancy tank having a plurality of compartments, each compartment having:

a permanently open vent through which water is freely flowable into and out of the compartment; and an inlet; and a conduit connecting the inlets of each compartment to one another and to a compressed air supply, the conduit having a plurality of separate conduit portions, each of the separate conduit portions corresponding to one of the plurality of compartments, respectively. the conduit including:

a first isolation valve provided between the inlet of the corresponding compartment and the atmosphere;

a second isolation valve provided between the inlet of the corresponding compartment and the compressed air supply; and an air non-return valve between the second isolation valve and the compressed air supply;

wherein, in use, air is expelled from the plurality of compartments into the atmosphere to cause the dock to sink, or compressed air is supplied to the plurality of compartments which increases the buoyancy of the tank, each air non-return valve being located and configured to prevent air from flowing from one of the plurality of compartments into another of the plurality of compartments.

2. The floating dock of claim 1, wherein each of the separate conduit portions have a splitter section.

3. The floating dock of claim 2, wherein, for each of the separate conduit portions, the first isolation valve is provided between one side of the splitter section and the atmosphere.

4. The floating dock of claim 3, wherein, for each of the separate conduit portions, the second isolation valve is provided between the other side of the splitter section and the compressed air supply.

5. The floating dock of claim 4, wherein, for each of the separate conduit portions, the air non-return valve is placed between the splitter section and the compressed air supply.

6. The floating dock of claim 1, wherein the submersible platform is formed by a plurality of buoyancy tanks secured to the underside of a flat plate or a series of cross members.

7. The floating dock of claim 1, wherein, for each of the plurality of compartments, the vent is located in the bottom of the buoyancy tank.

8. The floating dock of claim 6 wherein, for each of the plurality of compartments, the vent is located in the bottom of the buoyancy tank.

9. The floating dock of claim 1 wherein the vent for each of the plurality of compartments is a vent that runs along the entire length of the buoyancy tank.

10. The floating dock of claim 6 wherein the vent for each of the plurality of compartments is a vent that runs along the entire length of the buoyancy tank.

11. The floating dock of claim 7 wherein the vent for each of the plurality of compartments is a vent that runs along the entire length of the buoyancy tank.

12. The floating dock of claim 1 wherein, for each of the plurality of compartments, the vent comprises a series of holes each having a diameter of from 50-100 mm which are permanently open to the sea.

13. The floating dock of claim 6 wherein, for each of the plurality of compartments, the vent comprises a series of holes each having a diameter of from 50-100 mm that are permanently open to the sea.

14. The floating dock of claim 7 wherein, for each of the plurality of compartments, the vent comprises a series of holes each having a diameter of from 50-100 mm that are permanently open to the sea.

15. The floating dock of claim 9 wherein, for each of the plurality of compartments, the vent comprises a series of holes each having a diameter of from 50-100 mm that are permanently open to the sea.

16. The floating dock of claim 1 wherein each of the at least one buoyancy tank is generally cylindrical with walls made from a marine alloy or steel.

17. The floating dock of claim 1 wherein each of the at least one buoyancy tank comprises at least three compartments.

18. The floating dock according to claim 1 comprising at least three buoyancy tanks.

* * * * *